US010045111B1

(12) United States Patent
Bonner et al.

(10) Patent No.: US 10,045,111 B1
(45) Date of Patent: Aug. 7, 2018

(54) ON/OFF HEAD DETECTION USING CAPACITIVE SENSING

(71) Applicant: Bose Corporation, Framingham, MA (US)

(72) Inventors: Jordan Bonner, Waltham, MA (US); Peter T. Liu, Ashland, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/721,234

(22) Filed: Sep. 29, 2017

(51) Int. Cl.
*H04R 1/10* (2006.01)

(52) U.S. Cl.
CPC ..... *H04R 1/1041* (2013.01); *H04R 2420/07* (2013.01); *H04R 2460/01* (2013.01); *H04R 2460/03* (2013.01)

(58) Field of Classification Search
CPC ..... H04R 1/1041; H04R 2420/07; H04R 2460/01; H04R 2460/03; H04R 29/00
USPC ..... 381/74, 123
See application file for complete search history.

(56) References Cited

U.S. PATENT DOCUMENTS

| | | | |
|---|---|---|---|
| 6,452,494 | B1 | 9/2002 | Harrison |
| 7,010,332 | B1 | 3/2006 | Irvin et al. |
| 7,805,171 | B2 | 9/2010 | Alameh et al. |
| 7,925,029 | B2 | 4/2011 | Hollemans et al. |
| 7,945,297 | B2 | 5/2011 | Philipp |
| 8,045,727 | B2 | 10/2011 | Philipp |
| 8,155,334 | B2 | 4/2012 | Joho et al. |
| 8,315,406 | B2 | 11/2012 | Kon |
| 8,315,876 | B2 | 11/2012 | Reuss |
| 8,335,312 | B2 | 12/2012 | Gerhardt et al. |
| 8,428,053 | B2 | 4/2013 | Kannappan |
| 8,538,009 | B2 | 9/2013 | Gerhardt et al. |
| 8,559,621 | B2 | 10/2013 | Gerhardt et al. |
| RE44,980 | E | 7/2014 | Sargaison |
| 8,798,042 | B2 | 8/2014 | Kannappan |
| 8,798,283 | B2 | 8/2014 | Gauger, Jr. et al. |
| 8,805,452 | B2 | 8/2014 | Lee |
| 8,831,242 | B2 | 9/2014 | Brown et al. |

(Continued)

FOREIGN PATENT DOCUMENTS

| | | | |
|---|---|---|---|
| CN | 102761816 | B | 10/2012 |
| CN | 202721822 | U | 2/2013 |

(Continued)

*Primary Examiner* — Vivian Chin
*Assistant Examiner* — Ubachukwu Odunukwe
(74) *Attorney, Agent, or Firm* — Bond, Schoeneck & King, PLLC

(57) ABSTRACT

A system and method for detecting donning and doffing of an electronic device includes a capacitive sensor configured to generate a capacitance signal based on a capacitance measured by the sensor. The method also includes generating an average capacitance signal by averaging the capacitance signal over a period of time, and generating an intermediate signal based on a difference between the capacitance signal and the average capacitance signal. The method also includes generating a don or doff signal and setting the average capacitance signal to be equal to the capacitance signal when the don or doff signal is generated. The don signal is generated subsequent to the electronic device changing state from a doffed state to a donned state. The doff signal is generated subsequent to the electronic device changing state from a donned state to a doffed state.

20 Claims, 8 Drawing Sheets

(56) References Cited

U.S. PATENT DOCUMENTS

| | | | | |
|---|---|---|---|---|
| 8,907,867 | B2 | 12/2014 | Wong et al. | |
| 8,954,177 | B2 | 2/2015 | Sanders | |
| 9,094,764 | B2 | 7/2015 | Rosener | |
| 9,117,443 | B2 | 8/2015 | Walsh | |
| 9,123,320 | B2 | 9/2015 | Carreras et al. | |
| 9,124,970 | B2 | 9/2015 | Rabii et al. | |
| 9,264,803 | B1 * | 2/2016 | Johnson | H04R 3/00 |
| 9,280,239 | B2 | 3/2016 | Rosener | |
| 9,286,742 | B2 | 3/2016 | Rosener et al. | |
| 9,305,568 | B2 | 4/2016 | Kraft et al. | |
| 9,338,540 | B2 | 5/2016 | Nicholson | |
| 9,479,857 | B2 | 10/2016 | Rosener et al. | |
| 9,486,823 | B2 | 11/2016 | Andersen et al. | |
| 9,524,731 | B2 | 12/2016 | Kraft et al. | |
| 9,557,960 | B2 | 1/2017 | Kraft et al. | |
| 9,560,437 | B2 | 1/2017 | Jaffe et al. | |
| 9,584,899 | B1 | 2/2017 | Klimanis et al. | |
| 9,648,436 | B2 | 5/2017 | Kraft et al. | |
| 2005/0277446 | A1 | 12/2005 | Yueh | |
| 2006/0013079 | A1 | 1/2006 | Rekimoto | |
| 2006/0045304 | A1 | 3/2006 | Lee et al. | |
| 2006/0233413 | A1 | 10/2006 | Nam | |
| 2007/0274530 | A1 | 11/2007 | Buil et al. | |
| 2007/0281762 | A1 | 12/2007 | Barros et al. | |
| 2007/0297618 | A1 | 12/2007 | Nurmi et al. | |
| 2008/0130936 | A1 | 6/2008 | Lau et al. | |
| 2008/0260176 | A1 | 10/2008 | Hollemans et al. | |
| 2009/0124286 | A1 | 5/2009 | Hellfalk et al. | |
| 2009/0131124 | A1 | 5/2009 | Bibaud et al. | |
| 2009/0154720 | A1 | 6/2009 | Oki | |
| 2011/0007908 | A1 | 1/2011 | Rosener et al. | |
| 2011/0077056 | A1 | 3/2011 | Park et al. | |
| 2012/0086551 | A1 | 4/2012 | Lowe et al. | |
| 2012/0244812 | A1 | 9/2012 | Rosener | |
| 2013/0114823 | A1 | 5/2013 | Kari et al. | |
| 2013/0121494 | A1 | 5/2013 | Johnston | |
| 2013/0279724 | A1 | 10/2013 | Stafford et al. | |
| 2014/0066124 | A1 * | 3/2014 | Novet | H04M 1/72569 455/556.1 |
| 2014/0341387 | A1 | 11/2014 | Gauger, Jr. et al. | |
| 2015/0382106 | A1 | 12/2015 | Kraft et al. | |
| 2016/0142820 | A1 | 5/2016 | Kraft et al. | |
| 2016/0210111 | A1 | 7/2016 | Kraft | |
| 2016/0210958 | A1 | 7/2016 | Gauger, Jr. et al. | |
| 2016/0351183 | A1 | 12/2016 | Gauger, Jr. et al. | |
| 2017/0048616 | A1 | 2/2017 | Kraft et al. | |
| 2017/0099538 | A1 | 4/2017 | Kraft et al. | |
| 2017/0105064 | A1 | 4/2017 | Jaffe et al. | |
| 2017/0147284 | A1 | 5/2017 | Klimanis et al. | |
| 2017/0150246 | A1 | 5/2017 | Rule et al. | |

FOREIGN PATENT DOCUMENTS

| | | | | |
|---|---|---|---|---|
| CN | 103002373 | B | 3/2013 | |
| CN | 205071294 | U | 3/2016 | |
| CN | 205081948 | U | 3/2016 | |
| EP | 2009949 | | 12/2008 | |
| GB | 2469796 | A | 3/2010 | |
| JP | 2014045312 | * | 3/2014 | H04R 5/033 |
| WO | 2010014561 | A2 | 2/2010 | |
| WO | 2012162979 | | 12/2012 | |

* cited by examiner

600

From FIG. 5

ON/OFF HEAD DETECTION USING CAPACITIVE SENSING

TECHNICAL FIELD

The disclosure relates in general to an electronic device such as a headphone system, and more particularly, to determining whether the electronic device is being worn by a user.

BACKGROUND

Headphones and other electronic devices are often worn to listen to audio from an audio source, video source, or a combination. A user may remove and replace the headphones on his or her head more than once during a given time period. Automatically detecting an unworn headphone, removal of a headphone from a user's head, or replacement of a headphone on the user's head can be used to control playback of audio or other functionality of the headphones and/or conserve power in the headphones.

SUMMARY

All examples and features mentioned below can be combined in any technically possible way.

In one aspect, a computer-implemented method of detecting donning and doffing of an electronic device comprising includes generating a capacitance signal based on a capacitance measured by a capacitive sensor within the electronic device. The method further includes generating an average capacitance signal by averaging the capacitance signal over a period of time, and generating an intermediate signal comprising a difference between the capacitance signal and the average capacitance signal. The method further includes generating at least one of: a don signal and a doff signal, wherein the don signal is generated subsequent to the electronic device changing state from a doffed state to a donned state, and the doff signal is generated subsequent to the electronic device changing state from a donned state to a doffed state. The method further includes setting the average capacitance signal to be equal to the capacitance signal when a don or doff signal is generated.

Examples may include one of the following features, or any combination thereof. The don signal may be based on a comparison of the intermediate signal to a don threshold and the doff signal may be based on a comparison of the intermediate signal to a doff threshold. The don signal may be generated when a rising edge of the intermediate signal exceeds the don threshold. The don signal may be generated when the intermediate signal exceeds the don threshold for a predetermined period of time. The doff signal may be generated when a falling edge of the intermediate signal falls below the doff threshold. The doff threshold may be negative relative to a baseline such as the averaged signal. The doff signal may be generated when the intermediate signal falls below the doff threshold for a predetermined period of time. The average capacitance signal may be generated by averaging the capacitance signal over a plurality of acquired capacitance measurements.

The method may further include generating a weighted intermediate signal including the intermediate signal weighted by a weighting factor, and generating the average capacitance signal by summing the weighted intermediate signal and an average of the capacitance signal over a period of time.

The electronic device may include headphones.

The method may further include in response to generating a don signal, enabling one or more functions in the electronic device, and in response to generating a doff signal, disabling one or more functions in the electronic device. Enabling one or more functions in the electronic device may include at least one of: powering-on the electronic device, enabling active noise reduction in the electronic device, enabling wireless communication from the electronic device, answering a phone call, and playing audio from the electronic device. Disabling one or more functions in the electronic device may include at least one of: powering-off the electronic device, disabling active noise reduction in the electronic device, pausing audio from the electronic device, disabling wireless communication from the electronic device, muting or ceasing a phone call, ceasing to play audio from the electronic device, re-routing audio from the headphones to another device, which could be the source device such as a phone or any other playback device, enabling or disabling functionality for a single earpiece, and/or changing a characteristic of a single earpiece, among many other functions.

In another aspect, a headphone includes an ear piece for acoustically coupling the headphone to a wearer's ear, a capacitive sensor disposed in the ear piece for measuring a capacitance in the vicinity of the sensor, and one or more processing devices. The one or more processing devices are configured to generate a capacitance signal based on the sensed capacitance, generate an average capacitance signal by averaging the capacitance signal over a period of time, generate an intermediate signal that includes a difference between the capacitance signal and the average capacitance signal, generate at least one of: a don signal and a doff signal, and set the average capacitance signal to be equal to the capacitance signal when a don or doff signal is generated. The don signal is generated subsequent to the headphone changing state from a doffed state to a donned state, and the doff signal is generated subsequent to the headphone changing state from a donned state to a doffed state.

Examples may include one of the following features, or any combination thereof. The capacitive sensor may include a first electrode disposed within a front cavity of the ear piece, and a second electrode proximate to the first electrode, wherein the second electrode is a shielding electrode. The second electrode may be positioned within about 10 mm of the first electrode.

The don signal may be based on a comparison of the intermediate signal to a don threshold and the doff signal may be based on a comparison of the intermediate signal to a doff threshold. The don signal may be generated when a rising edge of the intermediate signal exceeds the don threshold, and the doff signal may be generated when a falling edge of the intermediate signal falls below the doff threshold. The doff threshold may be negative relative to a baseline.

The one or more processing devices may be further configured to generate a weighted intermediate signal comprising the intermediate signal weighted by a weighting factor, and generate the average capacitance signal by summing the weighted intermediate signal and an average of the capacitance signal over a period of time.

The one or more processing devices may be further configured to, in response to generating a don signal, enable one or more functions in the headphone, and, in response to generating a doff signal, disable one or more functions in the headphone. Enabling one or more functions in the headphone may include at least one of: powering-on the headphone, enabling active noise reduction in the headphone, enabling wireless communication from the headphone, answering a phone call, and playing audio from the headphone. Disabling one or more functions in the headphone may include at least one of: powering-off the headphone, disabling active noise reduction in the headphone, pausing audio from the electronic device, disabling wireless communication from the electronic device, muting or ceasing a phone call, and ceasing to play audio from the headphone.

In another aspect, a machine-readable storage device having encoded thereon computer readable instructions for causing one or more processors to perform operations including generating a capacitance signal based on a capacitance measured by a capacitive sensor within the electronic device. The operations further include generating an average capacitance signal by averaging the capacitance signal over a period of time, and generating an intermediate signal that includes a difference between the capacitance signal and the average capacitance signal. The operations further include generating at least one of: a don signal and a diff signal, and setting the average capacitance signal to be equal to the capacitance signal when a don or doff signal is generated. The don signal is generated subsequent to the electronic device changing state from a doffed state to a donned state, and the doff signal is generated subsequent to the electronic device changing state from a donned state to a doffed state.

The details of one or more implementations are set forth in the accompanying drawings and the description below. Other features, objects, and advantages will be apparent from the description and the drawings, and from the claims.

DETAILED DESCRIPTION

Figure 1:
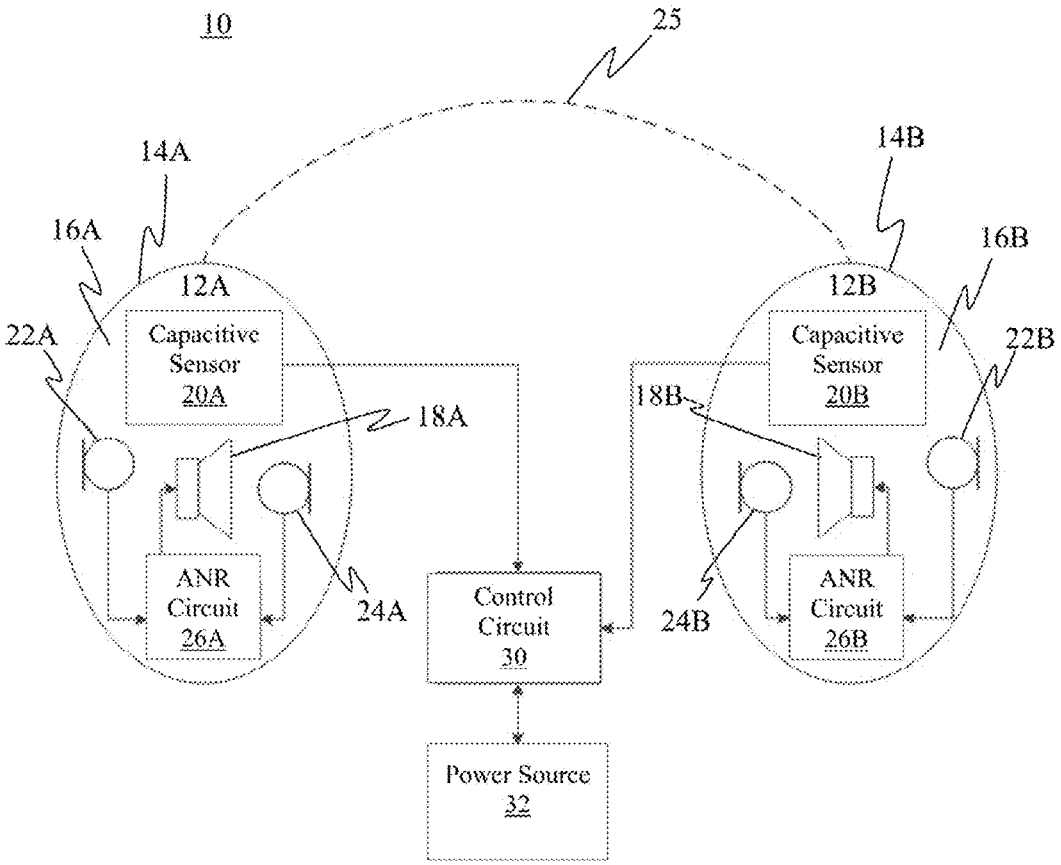
FIG. 1 is a schematic illustrating an example of a headphone with an on/off head detection system.

It has become commonplace for those who either listen to electronically provided audio (e.g., audio from an audio source such as a mobile phone, tablet, computer, CD player, radio or MP3 player), those who seek to be acoustically isolated from unwanted or possibly harmful sounds in a given environment, and those engaging in two-way communications to employ personal acoustic devices (i.e., devices structured to be positioned in, over or around at least one of a user's ears) to perform these functions. For those who employ headphones or headset forms of personal acoustic devices to listen to electronically provided audio, it is commonplace for that audio to be provided with at least two audio channels (e.g., stereo audio with left and right channels) to be separately acoustically output with separate earpieces to each ear. Further, developments in digital signal processing (DSP) technology have enabled such provision of audio with various forms of surround sound involving multiple audio channels. For those seeking to be acoustically isolated from unwanted or possibly harmful sounds, it has become commonplace for acoustic isolation to be achieved through the use of active noise reduction (ANR) techniques based on the acoustic output of anti-noise sounds in addition to passive noise reduction (PNR) techniques based on sound absorbing and/or reflecting materials. Further, it is commonplace to combine ANR with other audio functions in headphones.

In general, a headphone refers to a device that fits around, on, or in an ear, and that radiates acoustic energy into an ear canal. Headphones are sometimes referred to as earphones, earpieces, earbuds, ear cups, or sport headphones, and can be wired or wireless. A headphone includes an acoustic driver to transduce audio signals to acoustic energy. The acoustic driver may be housed in an ear cup or earbud. A headphone may be a single stand-alone unit or one of a pair of headphones (each including a respective acoustic driver and ear cup), such as one headphone for each ear. A headphone may be connected mechanically to another headphone, for example by a headband and/or by leads that conduct audio signals to an acoustic driver in the headphone. A headphone may include components for wirelessly receiving audio signals. A headphone may include components of an ANR and/or PNR system. A headphone may also include other functionality such as a microphone so that the headphone can function as a communication device.

Despite these advances, issues of user safety and ease of use of many personal acoustic devices remain unresolved. More specifically, controls (e.g., a power switch) mounted on or otherwise connected to a personal acoustic device that are normally operated by a user upon either positioning the personal acoustic device in, over or around one or both ears or removing it therefrom are often undesirably cumbersome to use. The cumbersome nature of the controls often arises from the need to minimize the size and weight of such devices by minimizing the physical size of the controls. Also, controls of other devices with which a personal acoustic device interacts are often inconveniently located relative to the personal acoustic device and/or a user. Further, regardless of whether such controls are in some way carried by the personal acoustic device or by another device with which the personal acoustic device interacts, it is commonplace for users to forget to operate these controls when they position the acoustic device in, over or around one or both ears or remove it therefrom.

Various enhancements in safety and/or ease of use may be realized through the provision of an automated ability to determine the positioning of an earpiece of a personal acoustic device relative to a user's ear. The positioning of an earpiece in, over or around a user's ear, or in the vicinity of a user's ear, may be referred to below as an "on head" or "donned" operating state. Conversely, the positioning of an earpiece so that it is absent from a user's ear, or not in the vicinity of a user's ear, may be referred to below as an "off head" or "doffed" operating state.

Various methods have been developed for determining the operating state of an earpiece as being on head or off head. Knowledge of a change in the operating state from on head to off head, or from off head to on head, can be applied for different purposes. For example, upon determining that at least one of the earpieces of a personal acoustic device has been removed from a user's ear to become off head, power supplied to the device may be reduced or terminated. Power control executed in this manner can result in longer durations between charging of one or more batteries used to power the device and can increase battery lifetime. Optionally, a determination that one or more earpieces have been returned to the user's ear can be used to resume or increase the power supplied to the device. The technology is described herein primarily using an example of a headphone. However, the description is also applicable to other personal electronic devices such as a smart watch or fitness tracker.

FIG. 1 is a schematic representation of an example headphone system 10 having two earpieces 12A and 12B, each configured to direct sound towards an ear of a user. Reference numbers appended with an "A" or a "B" indicate a correspondence of the identified feature with a particular one of the earpieces 12 (e.g., a left earpiece 12A and a right earpiece 12B). Each earpiece 12 includes a casing 14 that defines a cavity 16 in which an electro-acoustic transducer 18 and a capacitive sensor 20 is disposed. The earpieces 12 may be connected by a band 25 (in an on-ear or around-ear implementation), by a wire or cord (in an in-ear implementation) or may be completely wireless, with no band or cord between the earpieces. Each earpiece 12 may also include an ear coupling (e.g., an ear tip or ear cushion, not shown) attached to the casing 14 for coupling the earpieces to a user's ear or head. Although each earpiece 12 in FIG. 1 includes a capacitive sensor 20, it should be recognized that in some embodiments only one earpiece may include a capacitive sensor.

Each earpiece 12 may also include one or more microphones. In the example of FIG. 1, each earpiece 12 includes an external microphone 22 and an internal microphone 24. The external microphone 22 may be disposed on the casing in a manner that permits acoustic coupling to the environment external to the casing. The internal microphone 24 may be disposed within the casing near the output of the electro-acoustic transducer 18. In some examples, the internal microphone 24 is a feedback microphone and the external microphone 22 is a feed-forward microphone.

Each earphone 12 may also include an acoustic noise reduction (ANR) circuit 26 that is in communication with the external and internal microphones 22 and 24. The ANR circuit 26 receives an inner signal generated by the internal microphone 24 and an outer signal generated by the external microphone 22, and performs an ANR process for the corresponding earpiece 12. The process includes providing a signal to an electroacoustic transducer (e.g., speaker) 18 disposed in the cavity 16 to generate an anti-noise acoustic signal that reduces or substantially prevents sound from one or more acoustic noise sources that are external to the earpiece 12 from being heard by the user.

A control circuit 30 is in communication with the acoustic noise reduction (ANR) circuit 26, which in turn is in communication with the external and internal microphones 22 and 24. In certain examples, the control circuit 30 includes a microcontroller or processor having a digital signal processor (DSP) and the outer and inner signals from the microphones 22 and 24 are converted to digital format by analog to digital converters. In response to the received inner and outer signals, the control circuit 30 generates one or more signals which can be used for a variety of purposes, including controlling various features of the personal acoustic device 10. As illustrated, the control circuit 30 generates a signal that is used to control a power source 32 for the device 10. The control circuit 30 and power source 32 may be in one or both of the earpieces 12 or may be in a separate housing in communication with the earpieces 12.

Figure 2:
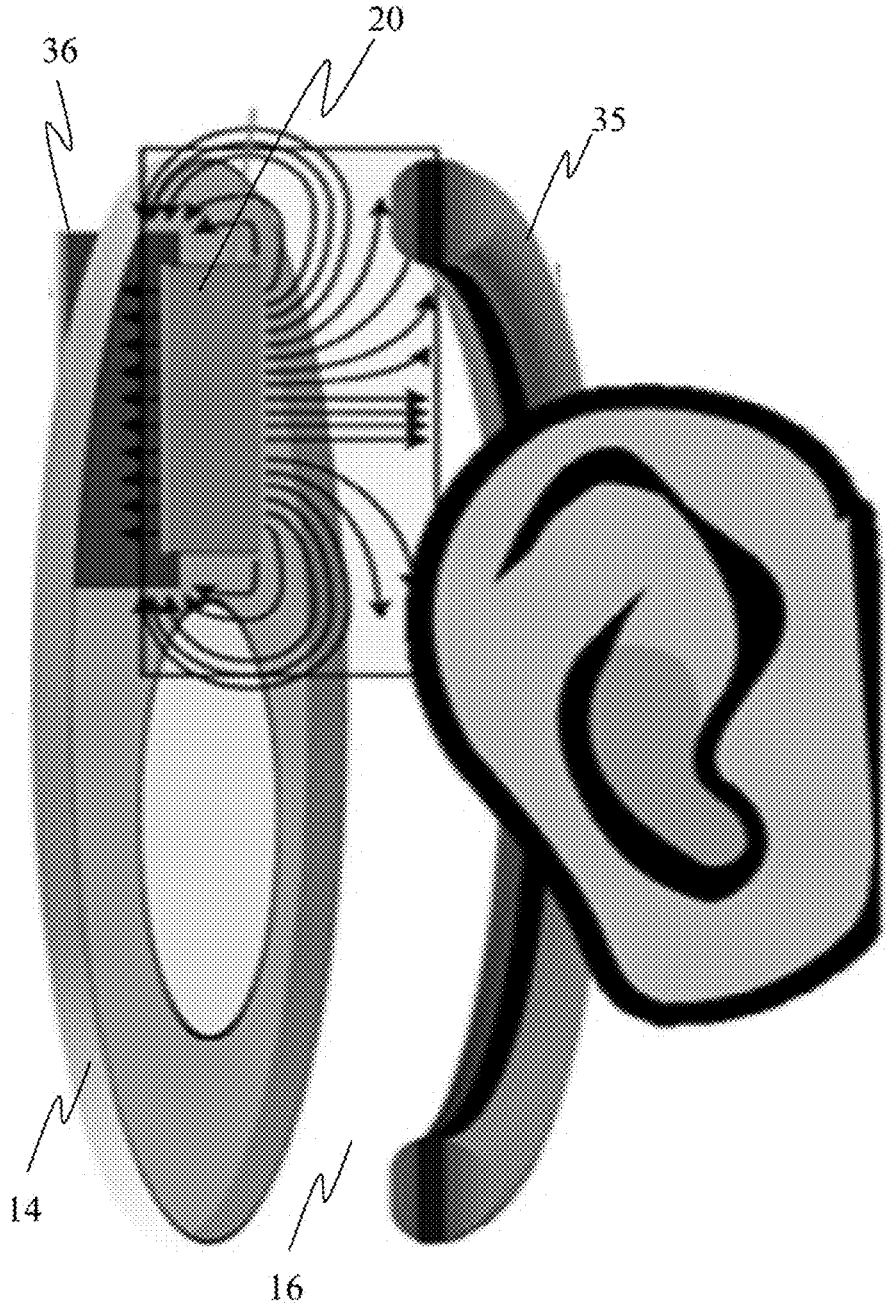
FIG. 2 is a schematic illustrating an example of a headphone ear cup with an on/off head detection system.

FIG. 2 is a schematic representation of an example earpiece 12 of an example headphone system 10, configured to direct sound towards an ear of a user. The earpiece 12 includes a casing 14 that defines a cavity 16 in which an electro-acoustic transducer 18 (not shown) and a capacitive sensor 20 is disposed. The capacitive sensor 20 may comprise one capacitor, or may comprise two or more capacitors. The earpiece 12 may also include an ear coupling 35 (e.g., an ear tip or ear cushion) attached to the casing 14 for coupling the earpieces to a user's ear or head. The earpiece 12 or capacitive sensor 20 may include a shield 36 to shield the capacitive sensor from environmental influences.

Figure 3:
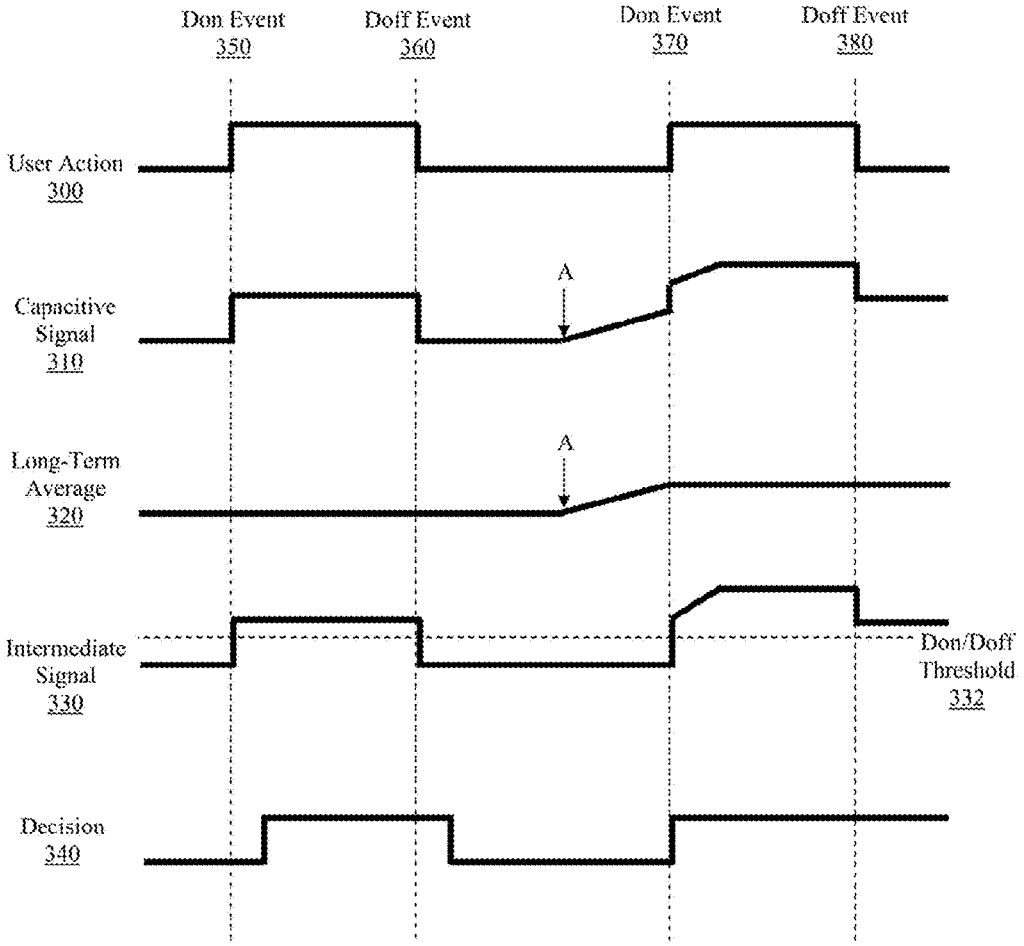
FIG. 3 PRIOR ART
FIG. 3 is graph illustrating an example of on/off head detection signals according to prior art systems.

FIG. 3 is graph illustrating an example of on/off head detection signals according to prior art systems using a capacitive sensor. At different times the user puts on the headphones (don events 350 and 370) and takes off the headphones (doff events 360 and 380), as shown by the signal representing user action 300. The initial don event 350 creates a capacitance signal event as shown by the capacitance signal 310. The system also creates a long-term running average 320 of the capacitance signal 310, and generates an intermediate signal 330, which is the raw capacitance signal 310 minus the long-term running average signal 320. At the initial don event 350, a capacitance signal 310 is generated and the intermediate signal 330 rises and peaks significantly since the long-term average 320 is low. As shown in FIG. 3, the intermediate signal 330 rises above the don/doff threshold 332, which triggers a don decision as shown by decision signal 340. The headphones, therefore, have determined that the user has donned the headphones and can take appropriate action, such as turning on the headphones, activating sound, activating the one or microphones, or taking a similar action. The intermediate signal 330 stabilizes as the capacitance signal 310 is stable and the long-term average 320 similarly stabilizes.

At doff event 360, the user takes off the headphones. The capacitance signal 310 drops due to removal, and the long-term average 320 slowly decreases as a result. The drop is enough to move the intermediate signal 330 below the doff threshold 334, which triggers a doff decision as shown by decision signal 340. The headphones, therefore, have determined that the user has doffed the headphones and can take appropriate action, such as turning off the headphones, deactivating sound, deactivating the one or microphones, or taking a similar action. The intermediate signal 330 stabilizes as the capacitance signal 310 is stable.

In the doffed state, such as following doff event 360 or 380 in FIG. 3, prior art solutions utilize long-term averaging only. Additionally, during the donned state such as following the donned state 350 or 370 in FIG. 1, prior art solutions stop the averaging algorithm and/or do not use the long-term average. Thus, during the donned state, the capacitive signal 310 will change and the long-term average 320 will stay fixed, thereby causing the intermediate signal 330 to drift. This drift of the intermediate signal 330 may prevent a doff event from meeting or surpassing the don/doff threshold 332. For example, in FIG. 3, the device is donned at don event 370. The prior art system or solution stops the long-term average algorithm, and thus the long-term average 320 is fixed even though the capacitive signal 310 increases while the device is donned. As a result, the intermediate signal 330 drifts, and although it changes following the doff event, it does not change enough to meet the don/doff threshold and the device misses the doff event. The user must then take some action to manually deactivate or otherwise manipulate the headphones.

Additionally, at point A in FIG. 3, the capacitive sensor in the headphones begins to experience a capacitive event or leak that slowly increases the capacitance signal. For example, the headphones may encounter an environmental condition that affects the capacitive sensor, such as humidity, temperature, or any other condition. As a result of the capacitive event, the capacitance signal 310 slowly increases as does the long-term average 320. This can further complicate the detection of a don/doff event, as shown in FIG. 3.

Figure 4:
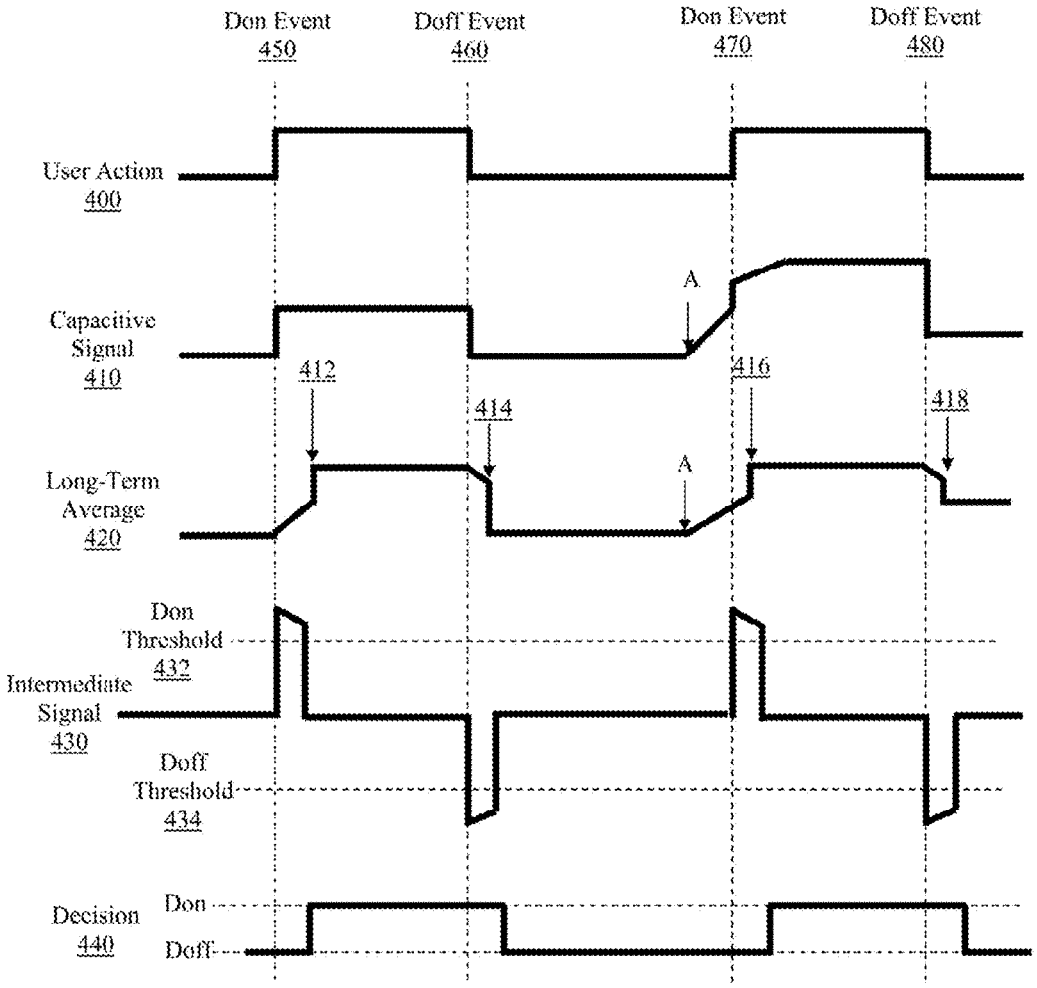
FIG. 4 is graph illustrating an example of on/off head detection signals.

FIG. 4 is graph illustrating an example of on/off head detection signals according to the inventive systems and methods described or otherwise envisioned herein. At different times the user puts on the headphones (don events 450 and 470) and takes off the headphones (doff events 460 and 480), as shown by the signal representing user action 400. The initial don event 450 creates a capacitance signal event as shown by the capacitance signal 410. The system also creates a long-term running average 420 of the capacitance signal 410, and generates an intermediate signal 430, which is the raw capacitance signal 410 minus the long-term running average signal 420. At the initial don event 450, a capacitance signal 410 is generated and the intermediate signal 430 rises and peaks significantly since the long-term average 420 is low. As shown in FIG. 4, the intermediate signal 430 rises above the don threshold 432, which triggers a don decision as shown by decision signal 440. The system, therefore, has determined that the user has donned the headphones and can take appropriate action, such as turning on the headphones, activating sound, activating the one or microphones, or taking a similar action. The intermediate signal 430 quickly returns to baseline as the capacitance signal 410 is stable and the long-term average 320 similarly stabilizes.

At doff event 460, the user takes off the headphones. The capacitance signal 410 drops due to removal, and the long-term average 420 begins to slowly decrease as a result. The drop is enough to move the intermediate signal 430 below the doff threshold 434, which triggers a doff decision as shown by decision signal 440. The headphones, therefore, have determined that the user has doffed the headphones and can take appropriate action, such as turning off the headphones, deactivating sound, deactivating the one or microphones, or taking a similar action.

At points 412, 414, 416, and 418, when a don or doff signal is generated, the system sets or resets the long-term average 420 of the capacitance signal to be equal to the capacitance signal 410, as shown in FIG. 4. Therefore, unlike prior art systems or solutions, the systems described or otherwise envisioned herein continue to utilize the long-term average donned state. The systems described or otherwise envisioned herein also address the effect of the capacitive event indicated by A in the graph. Thus, setting or resetting the long-term average 420 of the capacitance signal to be equal to the capacitance signal at 412, 414, 416, and/or 418, and/or utilizing the long-term average during the donned state, prevents a missed don or doff event and can also minimize the effect of the capacitive event A. Accordingly, in contrast to prior art methods, when the user dons the headphones at don event 470, there is an increase in the capacitance signal 410 and an accompanying increase in the long-term average 420 of the capacitance signal. The spike in the intermediate signal 430 rises above the don threshold 432, and the system determines that the user has doffed the headphones and can take appropriate action, such as turning off the headphones, deactivating sound, deactivating the one or microphones, or taking a similar action.

Figure 5:
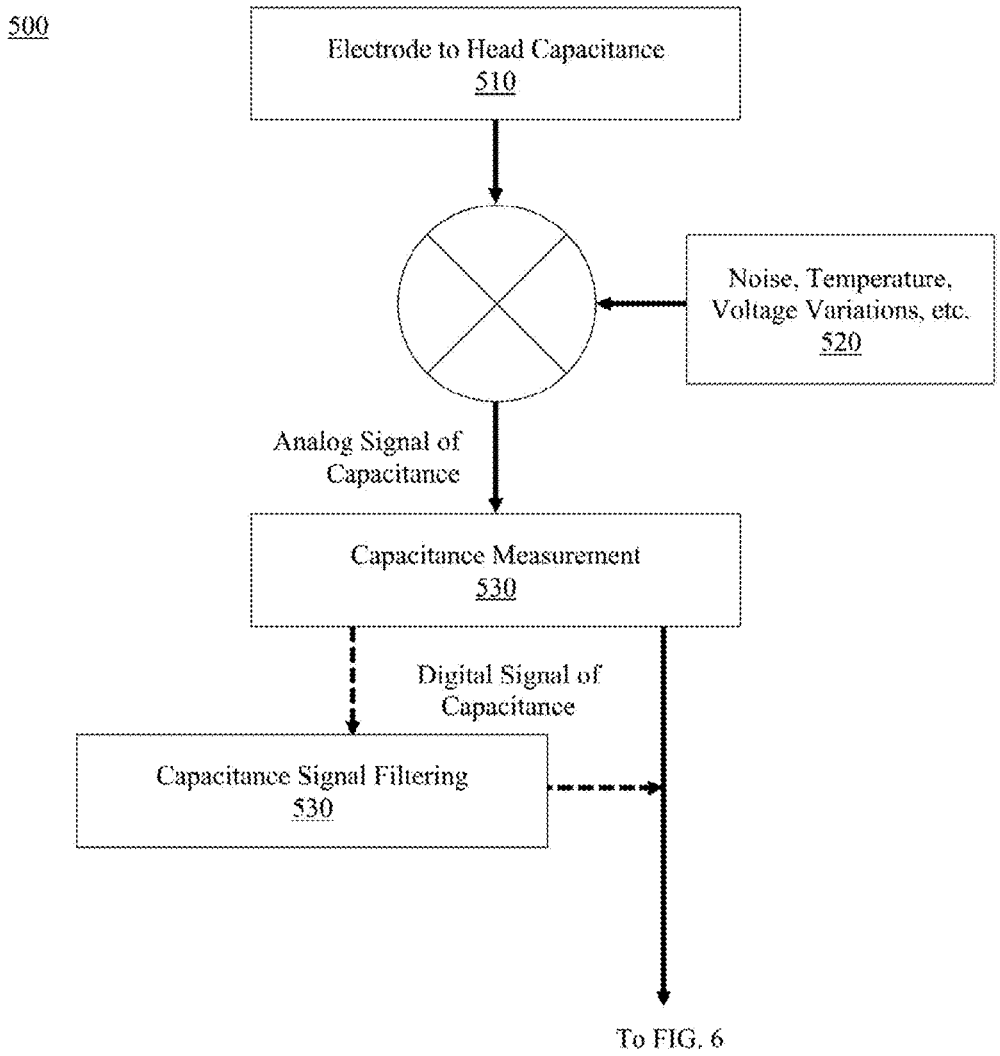
FIG. 5 is a block diagram depicting an example of how a determination of the operating state of an earpiece is made.

FIG. 5 is a block diagram depicting an example of how a determination of the operating state of an earpiece is made. At 510, there is a capacitance generated by the capacitive sensor 20 in the earpiece. This capacitance is affected by internal and/or external factors such as temperature, humidity, voltage variations, and other factors, to result in the final analog signal of capacitance. The capacitive sensor 20 then measures the capacitance at 530 to generate a digital signal of capacitance. Optionally, the digital signal of capacitance is filtered or otherwise pre-processed at 530 to generate a filtered or processed signal of capacitance.

Figure 6:
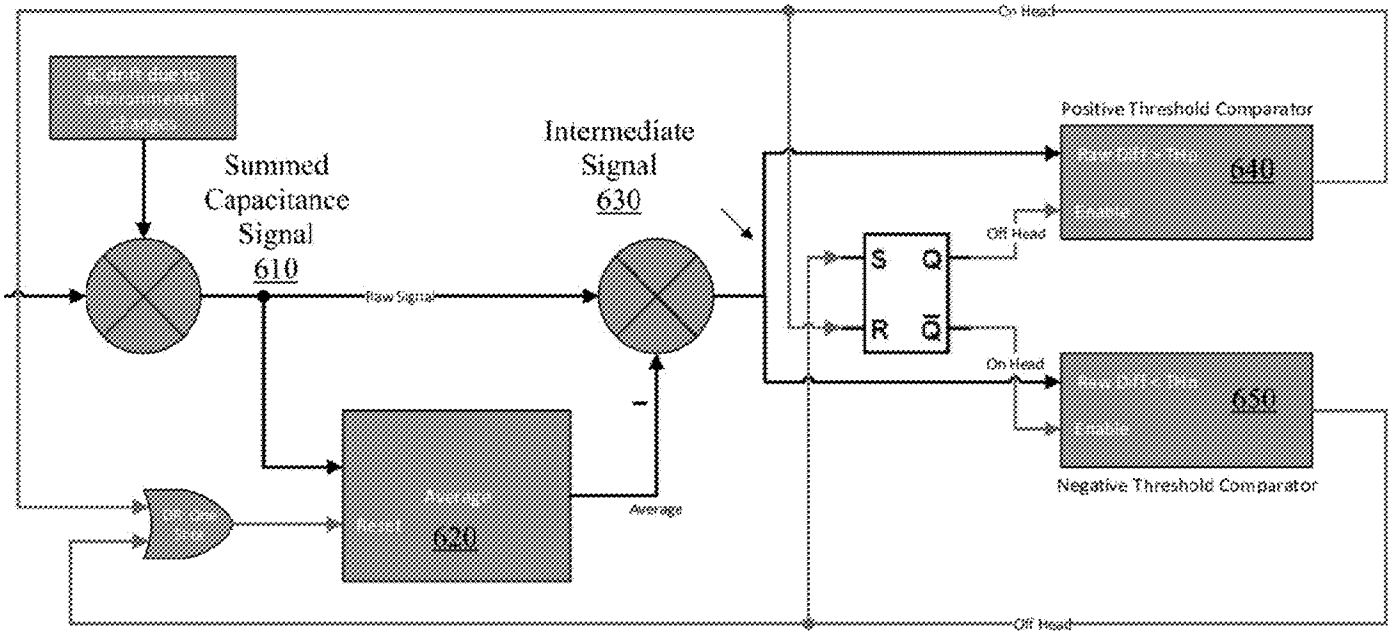
FIG. 6 is a block diagram depicting an example of how a determination of the operating state of an earpiece is made.

FIG. 6 is a block diagram depicting an example of how a determination of the operating state of an earpiece is made, and continues from FIG. 5. The block diagram 600 in FIG. 6 receives the digital signal of capacitance from FIG. 5, and sums the digital signal of capacitance with capacitance drift that results from environmental changes such as temperature changes, humidity changes, and/or many other changes that affect capacitance. The summed capacitance signal 610 (digital signal of capacitance plus capacitance drift) is utilized to generate a long-term running average 620. An intermediate signal 630 is generated from the summed capacitance signal 610 and the long-term running average 620 by subtracting the long-term running average 620 from the summed capacitance signal 610.

The intermediate signal 630 is provided to a positive threshold comparator 640 and a negative threshold comparator 650 to determine whether the signal satisfies either the don threshold or the doff threshold. If the don threshold is met, the system determines that the earpiece has been donned, and the system can activate a programmed or otherwise appropriate response. If the doff threshold is met, the system determines that the earpiece has been doffed, and the system can activate a programmed or otherwise appropriate response.

Once the system determines that the earpiece has been donned or doff, the system directs the long-term running average 620 to be set or reset to the capacitance signal 610.

Figure 7:
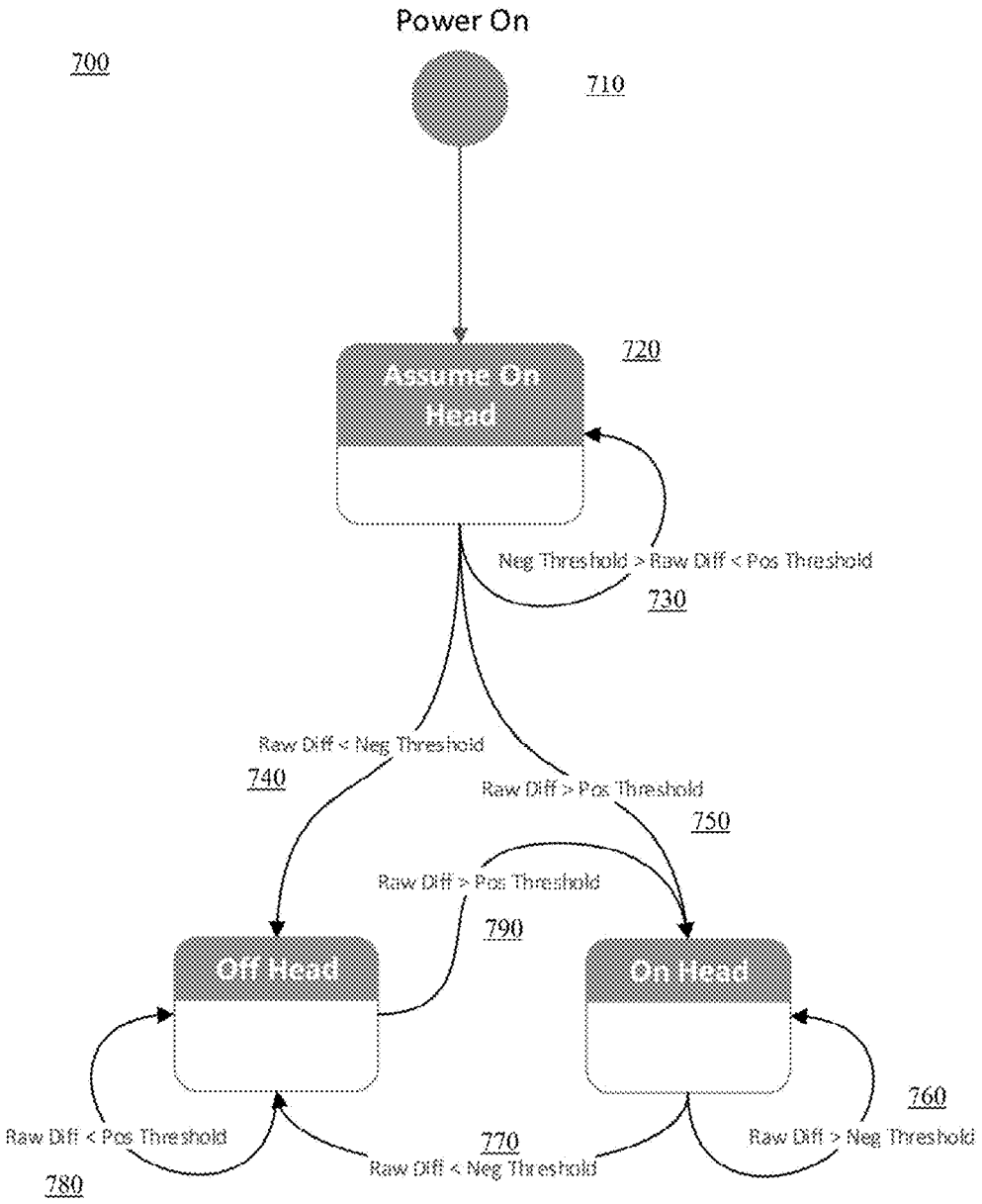
FIG. 7 is a state diagram depicting an example of a how a determination of the operating state of an earpiece is made.

FIG. 7 is a state diagram 700 depicting an example of a how a determination of the operating state of an earpiece is made, although many other examples are possible. At 710 the device is powered on, and the system assumes that the earpiece is donned. The system then measures and monitors the capacitance using capacitive sensor 20 to detect don and doff events. The system may periodically or continually monitor the capacitance using capacitive sensor 20.

The system also creates a long-term running average of the capacitance signal and generates an intermediate signal, which is the raw capacitance signal minus the long-term average signal. The system periodically or continually compares the intermediate signal to one or more thresholds to determine whether a don or doff event has occurred.

At 730, the system determines that the intermediate signal, the difference between the raw measured capacitance and the long-term average signal does not exceed either the negative or positive thresholds, and the system determines that a state change has not occurred. At 740, the system determines that the intermediate signal exceeds the negative threshold, and accordingly the system determines that a state change has occurred to change the status from don to doff. At 750, the system determines that the intermediate signal exceeds the positive threshold, and accordingly the system determines that a state change has occurred. At 760, the system periodically or continually monitors the don state of the earpiece by comparing the intermediate signal to the negative threshold. If the intermediate signal exceeds the negative threshold, the system determines that a state change has not occurred, and the earpiece is still donned. At 770, the intermediate signal does not exceed the negative threshold, and the system determines that a state change has occurred, and thus the earpiece has been doffed. At 780, the device is in the doff state and the system periodically or continually monitors the state of the earpiece by comparing the intermediate signal to the positive threshold. If the intermediate signal fails to exceed the positive threshold, then the system maintains the device in the doff mode. At 790, if the intermediate signal exceeds the positive threshold, then the system determines that a don event has occurred.

Figure 8:
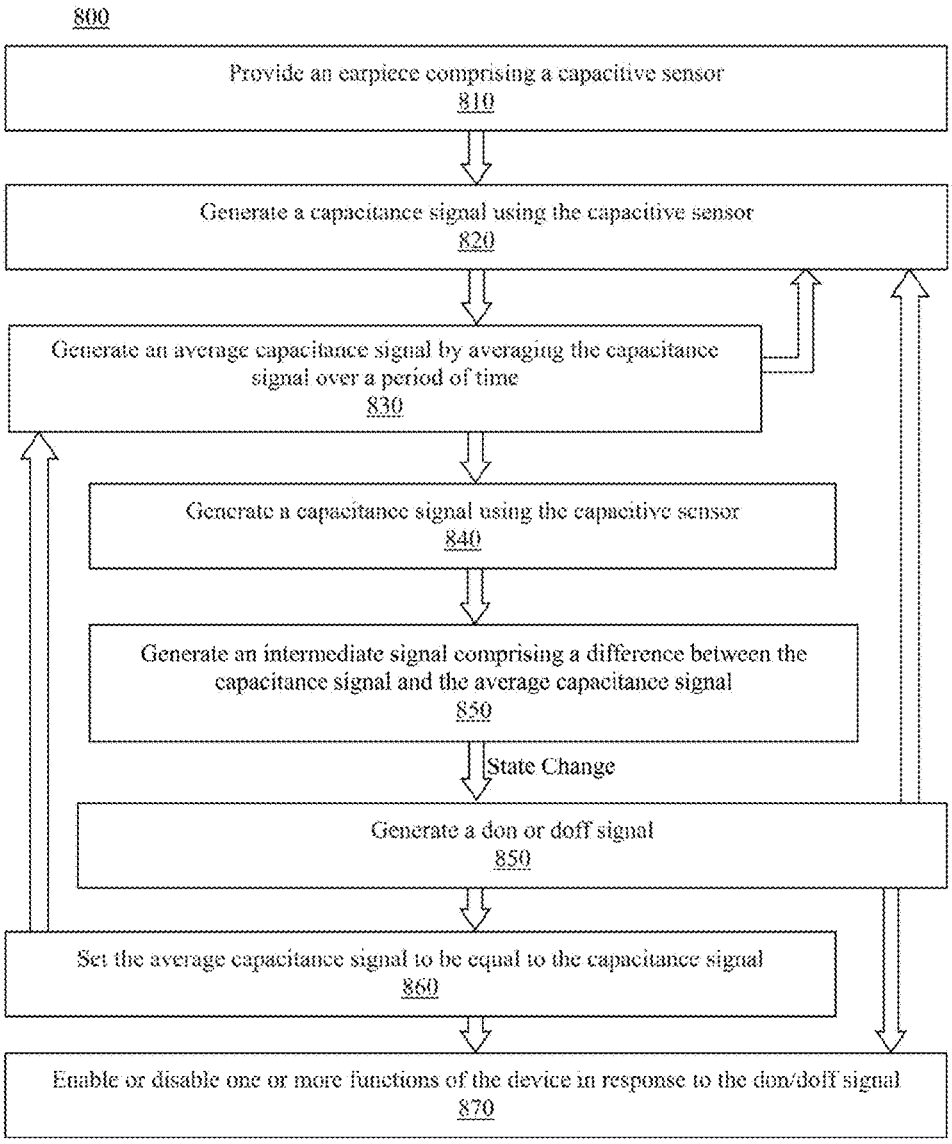
FIG. 8 is a flowchart of an example method of controlling a personal electronic device.

FIG. 8 is a flowchart of an example method 800 of detecting donning and doffing of an electronic device. At step 810, the electronic device 10 comprising one or more capacitive sensors 20 is provided. The device may be any of the devices described or otherwise envisioned herein, including but not limited to headphones or any other device with an earpiece.

At step 820, the system generates a capacitance signal based on a capacitance measured by the capacitive sensor 20 within the electronic device. The capacitive sensor may measure the capacitance and generate a capacitance signal either periodically or continuously.

At step 830, the system generates an average capacitance signal by averaging the capacitance signal over a period of time. For example, the system creates a long-term running average of the capacitance signal, which averages the capacitance signal for the any predetermined or programmed period of time, such as since a last state change, since the device was activated, or any other period of time. The average capacitance signal may be generated by averaging the capacitance signal over a period of about 1 second. According to an example, if the intermediate signal is weighted, the average capacitance signal may be generated by summing the weighted intermediate signal and an average of the capacitance signal over a period of time.

At step 840, the system generates an intermediate signal comprising a difference between the capacitance signal and the average capacitance signal. For example, the system can generate the intermediate signal by subtracting the average capacitance signal from the raw capacitance signal. According to an example, a weighted intermediate signal may be generated by weighting the intermediate signal with a weighting factor.

At step 850, the system generates either a don signal indicating that the electronic device has been donned, or a doff signal indicating that the electronic device has been doffed. For example, the don signal is generated subsequent to the electronic device changing state from a doffed state to a donned state. Similarly, the doff signal is generated subsequent to the electronic device changing state from a donned state to a doffed state. For example, the don signal can be based on a comparison of the intermediate signal to a don threshold, and the doff signal can be based on a comparison of the intermediate signal to a doff threshold. The don signal may be generated when a rising edge of the intermediate signal exceeds the don threshold, and/or the don signal may be generated when the intermediate signal exceeds the don threshold for a predetermined period of time. The doff signal may be generated when a falling edge of the intermediate signal falls below the doff threshold, and/or the doff signal may be generated when the intermediate signal falls below the doff threshold for a predetermined period of time. The doff threshold may be negative relative to a baseline.

At step 860, when the system has generated a don signal or a doff signal, the system sets the average capacitance signal to be equal to the capacitance signal.

At step 870, the system enables or disables one or more functions of the electronic device in response to a don or doff signal. For example, in response to generating a don signal, one or more functions in the electronic device are enabled. For example, the device may power-on the electronic device, enable active noise reduction in the electronic device, enable wireless communication from the electronic device, answer a phone call, play audio from the electronic device and/or enable any other provided function. Alternatively, in response to generating a doff signal, one or more functions in the electronic device are disabled. For example, the device may power-off the electronic device, disable active noise reduction in the electronic device, pause audio from the electronic device, disable wireless communication from the electronic device, mute or cease a phone call, cease to play audio from the electronic device, and/or disable any other provided function.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A computer-implemented method of detecting donning and doffing of a headphone, comprising:

generating a capacitance signal based on a capacitance measured by a capacitive sensor within the headphone;

generating an average capacitance signal by averaging the capacitance signal over a period of time;

generating an intermediate signal comprising a difference between the capacitance signal and the average capacitance signal, the intermediate signal having a baseline when the capacitance signal is equal to the average capacitance signal;

generating at least one of: a don signal and a doff signal, wherein the don signal is generated subsequent to the headphone changing state from a doffed state to a donned state, and the doff signal is generated subsequent to the headphone changing state from a donned state to a doffed state;

setting the average capacitance signal to be equal to the capacitance signal when a don or doff signal is generated;

returning the intermediate signal to the baseline in response to setting the average capacitance signal to be equal to the capacitance signal; and modifying an operational function of the headphone in response to the don signal or the doff signal.

2. The method of claim 1, wherein the don signal is based on a comparison of the intermediate signal to a don threshold and the doff signal is based on a comparison of the intermediate signal to a doff threshold, wherein the don threshold and the doff threshold are different.

3. The method of claim 2, wherein the don signal is generated when a rising edge of the intermediate signal exceeds the don threshold.

4. The method of claim 2, wherein the don signal is generated when the intermediate signal exceeds the don threshold for a predetermined period of time.

5. The method of claim 2, wherein the doff signal is generated when a falling edge of the intermediate signal falls below the doff threshold.

6. The method of claim 5, wherein the doff threshold is negative relative to the baseline.

7. The method of claim 2, wherein the doff signal is generated when the intermediate signal falls below the doff threshold for a predetermined period of time.

8. The method of claim 1, wherein the average capacitance signal is generated by averaging the capacitance signal over a plurality of acquired capacitance measurements.

9. The method of claim 1, further comprising:

generating a weighted intermediate signal comprising the intermediate signal weighted by a weighting factor; and generating the average capacitance signal by summing: the weighted intermediate signal and an average of the capacitance signal over a period of time.

10. The method of claim 1, the modifying further comprising:

in response to generating a don signal, enabling one or more functions in the headphone; and in response to generating a doff signal, disabling one or more functions in the headphone.

11. The method of claim 10, wherein:

enabling one or more functions in the headphone comprises at least one of: powering-on the headphone, enabling active noise reduction in the headphone, enabling wireless communication from the headphone, answering a phone call, and playing audio from the headphone; and disabling one or more functions in the headphone comprises at least one of: powering-off the headphone, disabling active noise reduction in the headphone, pausing audio from the headphone, disabling wireless communication from the headphone, muting or ceasing a phone call, ceasing to play audio from the headphone, routing audio to another device, enabling or disabling functionality for a single earpiece of the headphone, and/or changing a characteristic of a single earpiece of the headphone.

12. A headphone comprising:

an ear piece for acoustically coupling the headphone to a wearer's ear;

a capacitive sensor disposed in the ear piece for measuring a capacitance in a vicinity of the capacitive sensor;

one or more processing devices configured to:

generate a capacitance signal based on the sensed capacitance;

generate an average capacitance signal by averaging the capacitance signal over a period of time;

generate an intermediate signal comprising a difference between the capacitance signal and the average capacitance signal, the intermediate signal having a baseline when the capacitance signal is equal to the average capacitance signal;

generate at least one of: a don signal and a doff signal, wherein the don signal is generated subsequent to the headphone changing state from a doffed state to a donned state, and the doff signal is generated subsequent to the headphone changing state from a donned state to a doffed state;

set the average capacitance signal to be equal to the capacitance signal when a don or doff signal is generated;

return the intermediate signal to the baseline in response to the average capacitance signal being set equal to the capacitance signal; and modify an operational function of the headphone in response to the don or doff signals.

13. The headphone of claim 12, wherein the capacitive sensor comprises a first electrode disposed within a front cavity of the ear piece, and a second electrode proximate to the first electrode, wherein the second electrode is a shielding electrode.

14. The headphone of claim 12, wherein the don signal is based on a comparison of the intermediate signal to a don threshold and the doff signal is based on a comparison of the intermediate signal to a doff threshold.

15. The headphone of claim 14, wherein the don signal is generated when a rising edge of the intermediate signal exceeds the don threshold, and the doff signal is generated when a falling edge of the intermediate signal falls below the doff threshold.

16. The headphone of claim 15, wherein the doff threshold is negative relative to a baseline.

17. The headphone of claim 12, wherein the one or more processing devices is further configured to:

generate a weighted intermediate signal comprising the intermediate signal weighted by a weighting factor; and generate the average capacitance signal by summing: the weighted intermediate signal and an average of the capacitance signal over a period of time.

18. The headphone of claim 12, wherein the one or more processing devices is further configured to:

in response to generating a don signal, enable one or more functions in the headphone; and in response to generating a doff signal, disable one or more functions in the headphone.

19. The headphone of claim 18, wherein:

enabling one or more functions in the headphone comprises at least one of: powering-on the headphone, enabling active noise reduction in the headphone, enabling wireless communication from the headphone, answering a phone call, and playing audio from the headphone; and disabling one or more functions in the headphone comprises at least one of: powering-off the headphone, disabling active noise reduction in the headphone, pausing audio from the headphone, disabling wireless communication from the headphone, muting or ceasing a phone call, and ceasing to play audio from the headphone.

20. A machine-readable storage device having encoded thereon computer readable instructions for causing one or more processors to perform operations on a headphone, comprising:

generating a capacitance signal based on a capacitance measured by a capacitive sensor within the headphone;

generating an average capacitance signal by averaging the capacitance signal over a period of time;

generating an intermediate signal comprising a difference between the capacitance signal and the average capacitance signal, the intermediate signal having a baseline when the capacitance signal is equal to the average capacitance signal;

generating at least one of: a don signal and a doff signal, wherein the don signal is generated subsequent to the headphone changing state from a doffed state to a donned state, and the doff signal is generated subsequent to the headphone changing state from a donned state to a doffed state;

setting the average capacitance signal to be equal to the capacitance signal when a don or doff signal is generated;

returning the intermediate signal to the baseline in response to setting the average capacitance signal to be equal to the capacitance signal; and modifying an operational function of the headphone in response to the don signal or the doff signal.

* * * * *